US007909939B2

(12) United States Patent
Brewer et al.

(10) Patent No.: US 7,909,939 B2
(45) Date of Patent: Mar. 22, 2011

(54) HUMIDITY REDUCING EXHAUST DUCT FOR DISHWASHER

(75) Inventors: Mark Edward Brewer, West Allis, WI (US); Walter G. Stelzer, Pewaukee, WI (US); Kenyon A. Hapke, Libertyville, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 837 days.

(21) Appl. No.: 11/739,786

(22) Filed: Apr. 25, 2007

(65) Prior Publication Data

US 2008/0264455 A1 Oct. 30, 2008

(51) Int. Cl.
*B08B 3/00* (2006.01)

(52) U.S. Cl. ..... 134/56 D; 134/57 D; 134/58 D

(58) Field of Classification Search ..... 134/56 D, 134/57 D, 58 D

See application file for complete search history.

(56) References Cited

U.S. PATENT DOCUMENTS

| | | | | |
|---|---|---|---|---|
| 3,739,145 | A | | 6/1973 | Woehler |
| 3,807,420 | A | | 4/1974 | Donselman et al. |
| 4,098,616 | A | | 7/1978 | Dorius et al. |
| 4,195,419 | A | | 4/1980 | Quayle |
| 4,247,158 | A | | 1/1981 | Quayle |
| 4,268,973 | A | | 5/1981 | Jezuit et al. |
| 4,326,552 | A | | 4/1982 | Bleckmann |
| 4,657,036 | A | * | 4/1987 | Yake ..... 134/95.2 |
| 5,524,358 | A | | 6/1996 | Matz |
| 5,660,195 | A | | 8/1997 | Taylor, Jr. et al. |
| 5,881,746 | A | | 3/1999 | Buser et al. |
| 6,053,185 | A | | 4/2000 | Beevers |
| 2004/0079121 | A1 | * | 4/2004 | Yabuuchi et al. ..... 68/19.2 |
| 2006/0231122 | A1 | * | 10/2006 | Stelzer et al. ..... 134/18 |

FOREIGN PATENT DOCUMENTS

| | | | |
|---|---|---|---|
| DE | 0239012 | * | 3/1987 |
| DE | 199 46 456 | A1 | 9/1999 |
| EP | 0 239 012 | A1 | 3/1986 |
| EP | 0 521 815 | A1 | 6/1992 |
| EP | 0 920 830 | A1 | 6/1999 |
| EP | 1 084 672 | A2 | 8/2000 |
| EP | 1 127 532 | A2 | 2/2001 |
| EP | 1 447 042 | A1 | 8/2004 |

OTHER PUBLICATIONS

International Search Report and Written Opinion of the International Searching Authority for PCT/US2008/057614.

* cited by examiner

*Primary Examiner* — Michael Barr
*Assistant Examiner* — Jason Heckert
(74) *Attorney, Agent, or Firm* — Boyle Fredrickson, S.C.

(57) ABSTRACT

A vent system for a dishwasher provides a mixing chamber receiving high humidity air from a downdraft dishwasher vent system or the like and mixes this air with dry air before discharging it from the dishwasher to reduce the humidity of the discharged air moderating condensation problems.

18 Claims, 3 Drawing Sheets

HUMIDITY REDUCING EXHAUST DUCT FOR DISHWASHER

STATEMENT REGARDING FEDERALLY SPONSORED RESEARCH OR DEVELOPMENT

CROSS REFERENCE TO RELATED APPLICATION

Background of the Invention

The present invention relates to automatic dishwashing machines (dishwashers) and in particular to a dishwasher providing improved dish drying.

Dishwashers, such as those found in many homes, provide a wash cavity holding one or more racks into which eating utensils and cookware may be placed for cleaning. The wash cavity may be sealed by a door opening at the front of the wash cavity to allow loading and unloading of the chamber. The door is closed during a washing cycle to prevent the escape of water sprayed within the volume of the wash cavity and used to wash items placed in the racks. Upon completion of the washing cycle, a drying cycle is initiated during which water is drained from the wash cavity and moist air is discharged through a vent. Cool air, pulled by convection or a fan into the chamber through a lower vent, dries the heated dishes.

Recent dishwasher designs may employ a one-piece tub, for example of stainless steel, that defines the wash cavity and, when closed by the door, is sealed from communication with the outside air. The sealed nature of this chamber makes the promotion of air circulation for proper venting particularly difficult.

Co-pending U.S. application Ser. No. 11/108,525, entitled: "Dishwasher With Counter-Convection Air Flow", assigned to the same assignee as the present invention, and hereby incorporated by reference, describes a downdraft venting system in which low-turbulence down-flow is created within the wash cavity to more efficiently remove moisture laden air from the wash cavity and dishes. In one embodiment, a relatively small fan placed at the top of the wash cavity pushes air out of existing vents near the bottom of the washing machine door.

The greater efficiency of this design in removing moisture from the wash cavity and contained dishes can create condensation problems when high humidity air is exhausted from the dishwasher and contacts cool surfaces, such as a metal-faced dishwasher door. This condensation may cause the undesirable collection of water on surfaces near the vent outlet.

SUMMARY OF THE INVENTION

The present invention provides an improved vent system for a dishwasher that may accommodate high humidity air such as produced by downdraft venting systems. The vent provides a mixing chamber that mixes the humid air from the washing chamber with drier outside air before discharging it from the dishwasher. This cooling, and reduction of humidity by this cooling and dilution, greatly minimizes condensation problems. A dual fan embodiment also may be used for low drying efficiency systems where it is desired to reduce external condensation.

Specifically, the present invention provides a dishwasher with a venting system having a first opening leading into an upper area of a wash cavity and a second opening leading from a lower area of the wash cavity. A mixing chamber has a first inlet for receiving moist air from the second opening, a second inlet for receiving drier air from outside of the wash cavity, and an outlet displaced from the second inlet for venting the moist air to outside of the wash cavity. A fan communicates with one of the mixing chamber and the wash cavity to move air through the first and second inlets to be mixed within the mixing chamber and exhausted through the outlet. Air drawn through the first inlet, in turn, pulls air through the first opening leading into the wash cavity to flush moist air out of the wash cavity in a downward direction.

Thus it is one feature of at least one embodiment of the invention to provide a vent system that better accommodates high humidity air exhausted from high-efficiency downdraft venting systems.

In one embodiment of the invention, a first fan communicates with one of the mixing chamber and the wash cavity to move the moist air from the wash cavity into the first inlet of the mixing chamber, and a second fan communicates with the mixing chamber and operates independently of the first fan to move drier air into the mixing chamber via the second inlet to mix with the moist air prior to exit of the moist air from the outlet.

It is thus one feature of at least one embodiment of the invention to blow dry air directly into the mixing chamber with a second fan that is independent of a first fan venting the wash cavity to provide improved air mixing.

The mixing chamber may include a reservoir for capturing water condensing from the moist air and a control communicating with the first and second fan to operate the second fan when the first fan is not operating to dry the water collected in the reservoir.

It is thus one feature of at least one embodiment of the invention to condense water within the mixing chamber and then to operate the second fan to disperse this condensed moisture over a period extending beyond the time of the drying cycle.

The first fan may communicate with the wash cavity to receive dry air from outside the wash cavity and to blow the dry air into the wash cavity. Likewise, the second fan may communicate with the mixing chamber to receive dry air from outside the wash cavity and to blow drier air into the mixing chamber.

It is thus a feature of at least one embodiment of the invention to position the fans removed from the path of humid air flow, preventing corrosion or damage to the fans or the need for moisture resistant fans and fan components.

The second fan may be a brushless DC motor muffin fan.

It is thus another feature of at least one embodiment of the invention to make use of low-voltage, low power, quiet fans, of a type used for cooling in the computer industry, to reduce noise, power consumption, and risk of electrical shock in the dishwasher environment.

The second fan is displaced upward on the mixing chamber to be removed from a path of condensation draining down walls of the mixing chamber.

It is thus one feature of at least one embodiment of the invention to permit the use of water intolerant fans in a condensing system.

The first inlet in the mixing chamber may connect with a flow separator communicating through a wall of the wash chamber and also accepting a water line, wherein water from the water line also communicates through the flow separator into the wash chamber. The flow separator operates to prevent water from passing into the mixing chamber from the water line.

It is thus a feature of at least one embodiment of the invention to avoid the need to cut additional apertures in the walls of the wash cavity near the bottom of the tub, and thus the need for additional components and seals in a downdraft type system.

The mixing chamber may provide for a substantially horizontal airflow.

It is thus a feature of at least one embodiment of the invention to provide a simple method for producing a high surface area reservoir that may promote the evaporation of water contained in the reservoir.

The mixing chamber may be positioned in a wall of the dishwasher or in a door of the dishwasher.

It is thus a feature of at least one embodiment of the invention to provide a vent system that may be easily incorporated into a variety of dishwasher designs.

The invention may include a watertight tub defining the wash cavity for receiving dishes to be sprayed with water for washing, and the tub may be a single piece stainless steel tub.

It is thus a feature of at least one embodiment of the invention to provide a venting system particularly suited to sealed stainless steel tubs which present a venting problem and a condensation problem if aggressively vented.

These particular features and advantages may apply to only some embodiments falling within the claims and thus do not define the scope of the invention.

DETAILED DESCRIPTION OF THE PREFERRED EMBODIMENT

Figure 1:
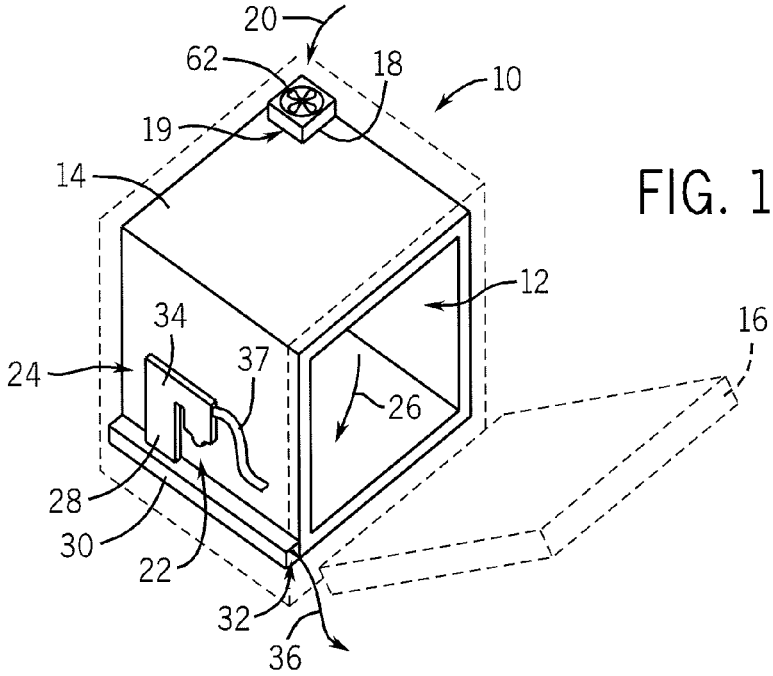
FIG. 1 is a perspective view of a wash cavity of a dishwasher showing the dishwasher housing and door in phantom and further showing the position of a first and second vent of the present invention.

Referring now to FIG. 1, a dishwasher 10 may include a wash cavity 12 into which dishes and cutlery may be placed for washing on racks (not shown). The wash cavity 12 may be defined by a generally rectangular tub 14, for example, of drawn stainless steel, providing a single piece sealable volume open at the front to be covered by a door 16 that seals against a front lip of the tub 14.

An opening 19 may be cut in the tub 14, for example, at a right rear edge of the top of the tub 14, for the attachment of a vent unit 18. The vent unit 18 includes a fan and an electrically actuable door (not shown) operating together to allow dry air 20 from outside of the wash cavity 12 to be blown into the tub 14 to cause a downward evacuation of the humid air within the tub 14 at the conclusion of the washing cycle when drying of the dishes is desired. The fan in the vent unit 18 may be so-called "muffin fan" using a low voltage brushless DC motor with the door protecting the brushless DC motor from exposure to water from inside the tub 14. A vent unit 18 suitable for this purpose is described in detail in the above cited application Ser. No. 11/108,525 incorporated by reference.

A second tub opening 22 may be cut in the lower left wall of the tub 14 allowing the connection of a second vent unit 24. The second vent unit 24 receives moist air 26 from inside the tub 14 and conducts it via a conduit 28 down a side of the tub 14 to a mixing chamber 30 positioned below the tub 14. The mixing chamber 30 provides a generally horizontal tube of rectangular cross section extending from the front to the back of the tub 14. At the front of the tub 14, the mixing chamber provides an exhaust port 32 underneath the door 16 for exhausting reduced humidity air 36.

The tub opening 22 connects to the conduit 28 by means of a flow separator 34 which also receives a source of water controlled by a solenoid valve (not shown) through hose 37. The water from the hose 37 is introduced into the tub 14 during a wash cycle for washing of the dishes and is controlled and dispersed within the wash cavity 12 according to methods well known in the art.

Figure 2:
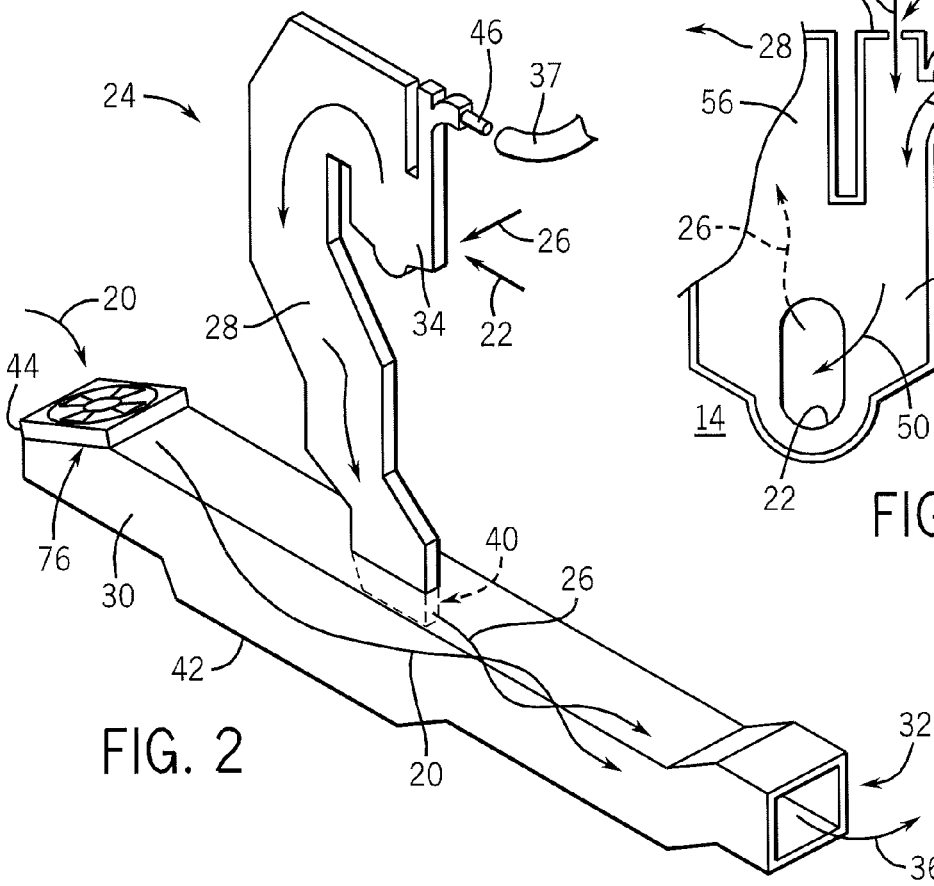
FIG. 2 is a perspective view in partial phantom of the lower vent of FIG. 1 showing a flow separator receiving air from the wash cavity and a mixing chamber mixing fresh air with the moist air from the wash cavity.

Referring now to FIG. 2, the moist air 26 from inside the tub 14 received from the tub opening 22 enters the flow separator 34 and is conducted downward through the conduit 28 which extends into the mixing chamber 30 passing through an upper wall of the mixing chamber 30. The end of the conduit 28 within the mixing chamber 30 has an opening 40 centered within the cross-section of the mixing chamber 30 and directed toward the exhaust port 32 to direct the moist air 26 exiting the conduit 28 toward the exhaust port 32. The conduit 28 is sealed at its point of entry into the mixing chamber 30 to prevent the escape of moist air 26 at the connection between the conduit 28 and the mixing chamber 30.

A second fan 44 of similar construction to the fan of vent unit 18, and being in the preferred embodiment a second brushless DC motor fan, is attached at an intake port 76 at an end of the mixing chamber opposite the exhaust port 32. The use of a brushless DC motor allows the fan 44 to operate on a low-voltage that may be readily routed in the environment of the dishwasher with considerable safety and allows positioning of the fan motor within the hub of the fan to provide an extremely compact package.

The fan 44 is positioned to draw dry air 20 from beneath the tub 14 into the mixing chamber 30 through the intake port 76 and to direct that dry air along the axis of the mixing chamber toward the exhaust port 32. Downstream from the opening 40 of the conduit 28 is a mixing region at which the moist air 26 and dry air 20 mix. Airflow from the fan 44 serves to draw the moist air 26 out of the conduit 28 into turbulent mixing with the dry air 20. This mixing cools the moist air 26 causing some condensation within the mixing chamber 30 and diluting the moist air 26 to lower its average humidity and thus its dew point, a measure of its propensity to cause condensation outside of the dishwasher 10 on the metallic surfaces of the door 16 or elsewhere in the kitchen environment. The reduced humidity air 36 exits the exhaust port 32.

A lower wall of the mixing chamber 30 beneath the conduit 28 provides a shallow reservoir 42 in the form of a depression that may collect water condensing out of the moist air 26 while the moist air 26 is within the conduit 28 and the mixing chamber 30. The fan 44 may be positioned on a top surface of the mixing chamber 30 to be removed from the water in the reservoir 42 and from any drip path of condensation on the inner walls of the mixing chamber 30.

Figure 3:
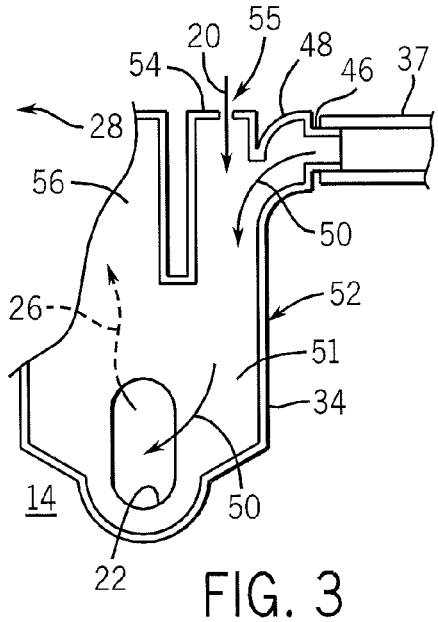
FIG. 3 is an elevational cross-section of the flow separator of FIG. 2 showing a U-shaped channel providing for separation of water and airflow through a single aperture leading to the wash cavity.

Referring also now to FIG. 3, the flow separator 34 may receive a water hose 37 at a hose fitting 46 leading to a downwardly curved diverter section 48 directing water 50 received horizontally from the hose 37 downward through a chimney 52. The chimney 52 connects at its lower end to a base 51 of the flow separator 34, the base covering and communicating with the tub opening 22 so that the water 50 within the base may pass into the tub 14. A bifurcation in the upper end of the chimney 52 provides a second anti-siphon chimney 54 having a small vent 55 admitting dry air 20 when water 50 is flowing downward in the chimney 52 so as to form a siphon break preventing the siphoning of water out of the flow separator 34 into the hose 37 (and then into the water supply) in the event of a possible decrease in water pressure on the hose 37.

The base 51 also communicates with a third chimney 56 leading upward to join with conduit 28. The third chimney provides an upward path from the tub opening 22 that may conduct moist air 26 through the tub opening 22 (when water is not flowing through the tub opening 22) and out of the tub 14. The small vent 55 in the second anti-siphon chimney 54 is small enough that no significant amounts of moist air 26 will flow out of the small vent 55.

Water flowing into the hose fitting 46 is sufficiently restricted in comparison to the size of the aperture 33 so that that water 50 will never rise sufficiently within the base to enter the chimney 56 and thus flow through the conduit 28. In this way, the flow separator 34 allows a dual use of tub opening 22 at different times: first, for admission of water 50 during washing cycle and, second, for the extraction of moist air 26 during a drying cycle.

Figure 4:
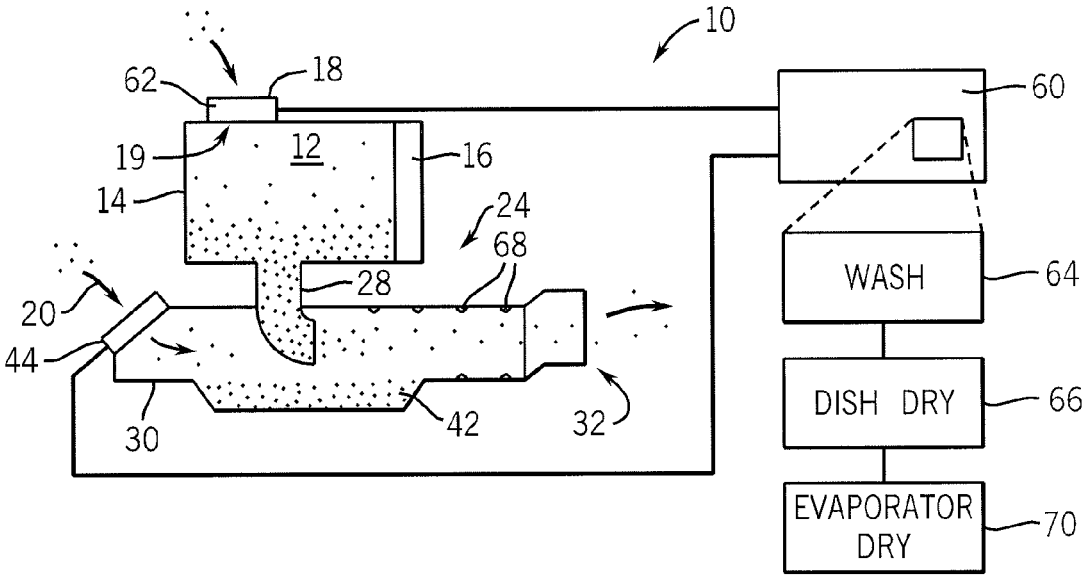
FIG. 4 is an elevational schematic representation of the dishwasher of FIG. 1 showing humidity concentrations inside and outside the wash cavity as managed by the present invention under the control of a controller executing a timing cycle.

Referring now to FIG. 4, the dishwasher may include a cycle timer 60 of a type known in the art communicating with a fan 62 of the vent unit 18 and the fan 44 on the mixing chamber 30 to provide electrical signals switching these fans on and off at different times. During a first wash stage 64, the cycle timer 60 may provide a signal to a flapper valve (not shown) within the vent unit 18 closing that flapper valve to protect the fan 62 from moisture. At this time, fans 62 and 44 are turned off and a solenoid valve communicating with the hose 37 of FIG. 2 is opened to allow water to flow into the tub 14.

At the conclusion of the wash stage 64, a dish dry stage 66 is begun and the cycle timer stops water flow through the hose 37, opens the flapper valve and turns fans 62 and 44 on to flush the wash cavity 12 with dry air 20 and to mix dry air 20 with the exhausting moist air 26 in the mixing chamber 30. During the dish dry stage 66, fan 62 introduces dry air 20 into the wash cavity 12 at a low velocity that preferentially exhausts the high humidity air from the bottom of the wash cavity 12 downward through the conduit 28 into the mixing chamber 30 without disruption of the stratification of moisture within the wash cavity 12.

The mixing chamber 30 accommodates the high moisture content of the air exhausted from the wash cavity 12 by dilution and condensation as described above.

An evaporator dry stage 70 occurs after the dishes are dry and fan 62 is turned off. During the evaporator dry stage 70, the fan 44 may optionally remain on. No significant amount of moist air 26 enters the mixing chamber 30, but the dry air 20 is used to provide for evaporation of moisture collected in the reservoir 42, drying the reservoir 42 for future use.

Figure 5:
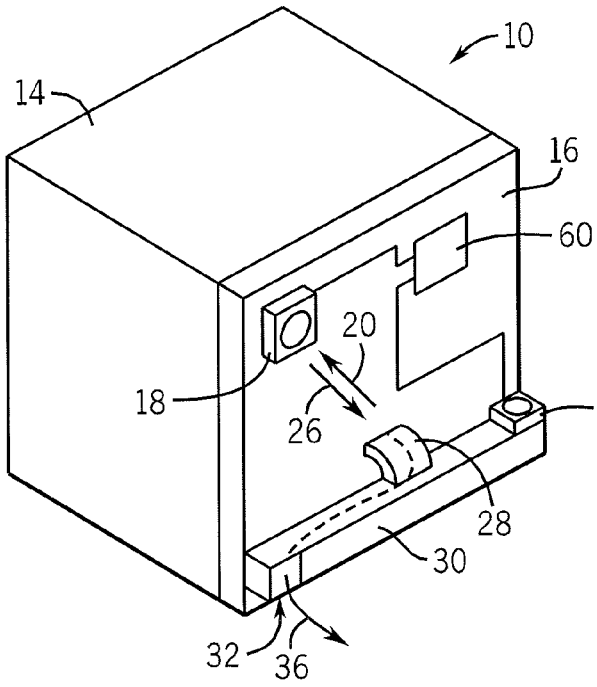
FIG. 5 is a perspective view of a dishwasher, with the door in partial phantom, showing an alternative placement of the invention within the door.

Referring now to FIG. 5, the present invention provides a vent system that may be flexibly located within the door 16 of the dishwasher 10. In this case, the vent unit 18 is positioned high within the door 16 to communicate through an opening in the inner surface of the door 16 with an upper portion of the wash cavity 12. Similarly, the conduit 28 is positioned low in the door 16 to communicate through an opening in the inner surface of the door 16 with a lower portion of the wash cavity 12. The horizontal mixing chamber 30 is placed along the bottom of the door 15 extending from right to left. This positioning reduces wiring harness lengths.

Figure 6:
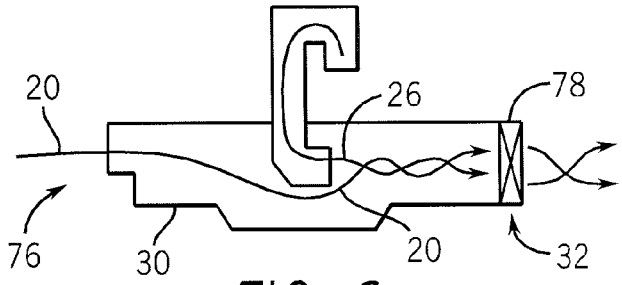
FIG. 6 is a schematic representation of an alternative embodiment of the invention using a single fan to draw air through the mixing chamber and/or the wash cavity.

Referring now to FIG. 6, in an alternative embodiment, fan 44 may be removed leaving intake port 76 open to admit dry air 20 into the mixing chamber 30. A moisture tolerant fan 78 may then be placed at the exhaust port 32 to draw the mixed moist air 26 and dry air 20 together out of the exhaust port 32. A similar mixing and condensing process may occur however with less baffling of the noise of the fan 78. With such an approach and the proper sizing of the tub opening 22, conduit 28, opening 40 and intake port 76, it may be possible to remove the fan 62 to provide a single fan system achieving the benefits of downdraft venting.

Figure 7:
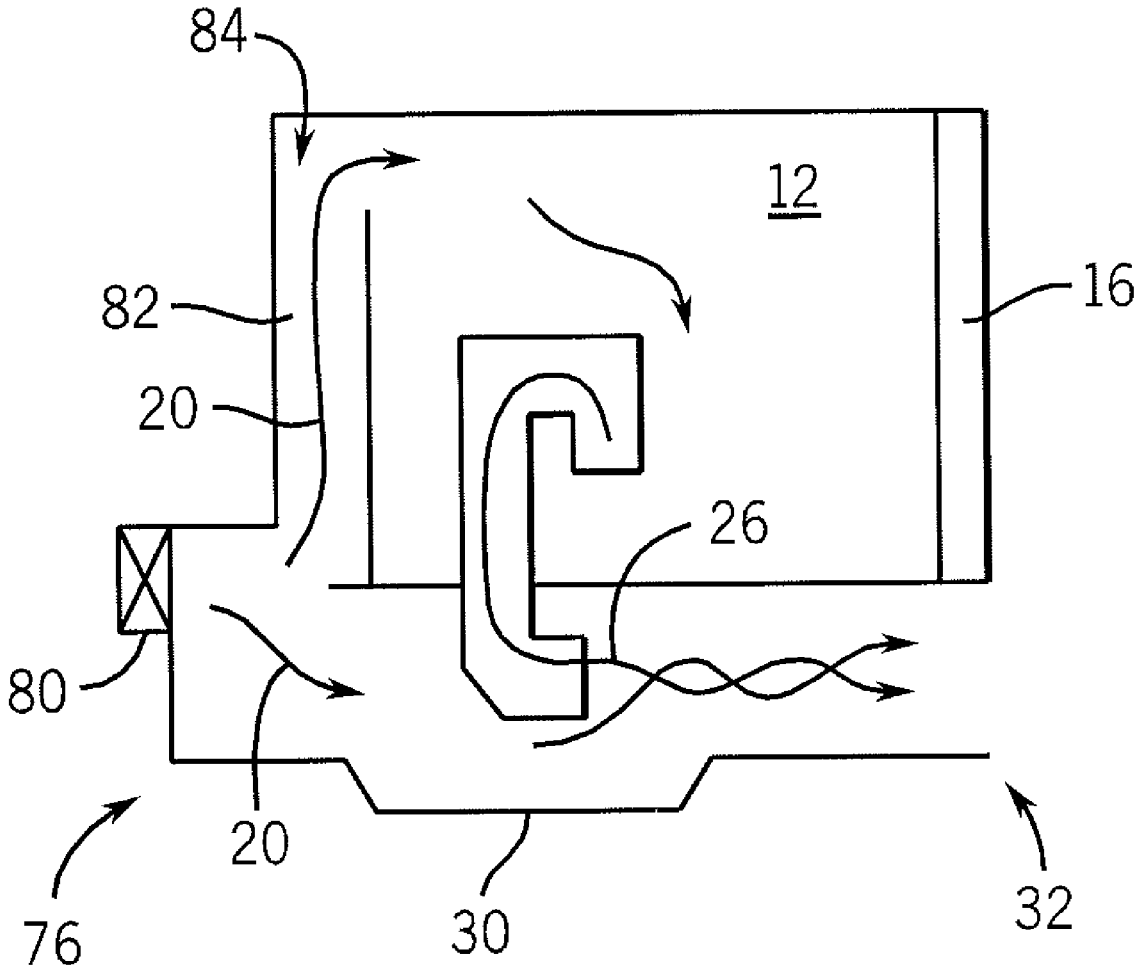
FIG. 7 is a figure similar to that of FIG. 6 of an alternative embodiment of the invention using a single fan to push air through the mixing chamber and/or the wash cavity.

Referring now to FIG. 7, in yet an alternative embodiment, a fan 80 may be placed to both introduce dry air 20 into the mixing chamber 30 at intake port 76, and by means of a duct 82, to also conduct dry air 20 through an upper opening 84 in the wash cavity 12. Like the embodiment of FIG. 6, a single fan may thus provide the benefits of downdraft venting together with the humidity reducing effect of the mixing chamber 30. Unlike the embodiment of FIG. 6, the fan 80 need not be moisture tolerant and is removed from exhaust port 32 reducing fan noise.

In each of the embodiments of FIGS. 6 and 7, the fans 78 and 80 may be conventional blowers employing either DC or AC motors.

The terms moist air and dry air as used herein are not intended to convey any absolute level of humidity but to broadly characterize the air within a dishwasher after washing dishes and the normal level of humidity of air outside of the dishwasher.

It is specifically intended that the present invention not be limited to the embodiments and illustrations contained herein, but include modified forms of those embodiments including portions of the embodiments and combinations of elements of different embodiments as come within the scope of the following claims.

We claim:

1. A vent system for a dishwasher comprising:

a mixing chamber having a first inlet for receiving moist air from a wash cavity of the dishwasher, a second inlet for receiving drier air from outside of the wash cavity and an outlet displaced from the second inlet for venting the moist air to outside of the wash cavity, and a condensation reservoir for collecting water condensing out of the moist air;

a first fan having a first motor and communicating with one of the mixing chamber and the wash cavity to move the moist air from the wash cavity into the first inlet; and a second fan having a second motor and communicating with the mixing chamber and operable independently of the first fan to (i) move drier air into the mixing chamber via the second inlet to mix with the moist air prior to exit of the moist air from the outlet, and (ii) move drier air across the collected water such that the collected water is removed from the condensation reservoir by evaporation therefrom.

2. The vent system of claim 1 wherein the condensation reservoir defines a depression displaced from the second fan and a cycle timer communicating electric signals with the first and second fan to operate the second fan when the first fan is not operating to move the moist air from the wash cavity into the first inlet of the mixing chamber.

3. The vent system of claim 1 wherein the first fan communicates with the wash cavity to receive at the first fan drier air from outside the wash cavity before mixing with moist air in the tub and to blow the drier air into the wash cavity.

4. The vent system of claim 3 wherein the second fan communicates with the mixing chamber to receive at the second fan drier air from outside the wash cavity before mixing with moist air in the tub and to blow drier air into the mixing chamber.

5. The vent system of claim 1 wherein the second fan is displaced upward from the mixing chamber to be removed from a path of condensation draining down walls of the mixing chamber.

6. The vent system of claim 1 wherein the second fan is a brushless DC muffin fan.

7. The vent system of claim 1 wherein the first and second fans are brushless DC muffin fans.

8. The vent system of claim 1 wherein the first inlet connects with a flow separator communicating through a wall of the wash chamber and accepting, from a water line, water also communicating through the flow separator into the wash chamber, the flow separator preventing water from passing into the mixing chamber from the water line.

9. The vent system of claim 1 wherein the mixing chamber provides for a substantially horizontal airflow.

10. The vent system of claim 1 wherein the second fan and first inlet are positioned to provide for flushing of air from the wash cavity in a downward direction without substantial mixing with in the wash cavity.

11. The vent system of claim 1 wherein the mixing chamber is positioned in a wall of the dishwasher.

12. The vent system of claim 1 wherein the mixing chamber is positioned in a door of the dishwasher.

13. The vent system of claim 1 further including a watertight tub defining the wash cavity for receiving dishes to be sprayed with water for washing.

14. The vent system of claim 13 wherein the tub is a single piece stainless steel tub.

15. A dishwasher with a venting system comprising:

a wash cavity having a first opening in a wash cavity wall leading into an upper area of the wash cavity;

a mixing chamber having a first inlet for receiving moist air from a second opening in the wash cavity wall leading into a lower area of the wash cavity of the dishwasher and a second inlet for receiving drier air from outside of the wash cavity, an outlet displaced from the second inlet for venting the moist air to outside of the wash cavity, and a condensation reservoir for collecting water condensing out of the moist air and holding the collected water until it evaporates therefrom;

a fan having a motor communicating with at least one of the mixing chamber and the wash cavity to move air through the first and second inlets to be mixed within the mixing chamber and exhausted through the outlet, wherein the fan moves dry air from outside the wash cavity into the wash cavity through the first opening to flush the wash cavity in a downward direction and then to be drawn into the mixing chamber through the first inlet and the fan moves dry air from outside the wash cavity into the second inlet for mixing with air from the first inlet; and wherein the fan is positioned upstream of at least one of the mixing chamber and wash cavity to be out of the path of moist air from inside the wash cavity; and wherein the fan is a brushless DC muffin fan.

16. The vent system of claim 15 wherein the mixing chamber provides for a substantially horizontal airflow.

17. The vent system of claim 15 wherein the first inlet connects with a flow separator communicating through a wall of the wash chamber and accepting, from a water line, water also communicating through the flow separator into the wash chamber, the flow separator preventing water from passing into the mixing chamber from the water line.

18. The vent system of claim 1 further including a cycle timer operating the first and second fans together at a first time and operating the second fan alone at a second time following the first time.

* * * * *